US005513391A

United States Patent [19]

Garneau et al.

[11] Patent Number: 5,513,391

[45] Date of Patent: May 7, 1996

[54] ANTI-SLIPPAGE GLOVE

[75] Inventors: Louis Garneau, Saint-Augustin-de-Desmaures; Philip Brook, Québec, both of Canada

[73] Assignee: Louis Garneau Sports Inc., Desmaures, Canada

[21] Appl. No.: 424,755

[22] Filed: Apr. 18, 1995

[51] Int. Cl.[6] ..... A41D 19/00

[52] U.S. Cl. ..... 2/161.1; 2/160

[58] Field of Search ..... 2/159, 160, 161.1, 2/161.2, 161.4, 162, 917, 161.5, 161.6

[56] References Cited

U.S. PATENT DOCUMENTS

| | | | |
|---|---|---|---|
| 351,724 | 10/1886 | Urwick | 2/159 |
| 2,083,604 | 6/1937 | Hay | 2/159 |
| 2,567,489 | 9/1951 | Lewis | 2/20 |
| 4,042,977 | 8/1977 | Antonious . | |
| 4,057,255 | 11/1977 | Bishop | 2/161.4 |
| 4,958,384 | 9/1990 | McCrane . | |
| 5,033,119 | 7/1991 | Wiggins | 2/162 |
| 5,088,122 | 2/1992 | O'Toole | 2/161.4 |
| 5,195,188 | 3/1993 | Bourdeau et al. | 2/159 |
| 5,197,149 | 3/1993 | Overton . | |

FOREIGN PATENT DOCUMENTS

| | | | |
|---|---|---|---|
| 1291596 | 11/1991 | Canada . | |
| 2093406 | 11/1993 | Canada . | |
| 6079029 | 3/1994 | Japan | 2/161.2 |

*Primary Examiner*—Michael A. Neas

*Attorney, Agent, or Firm*—Ronald S. Kosie; Robert Brouillette

[57] ABSTRACT

A glove provided with a releasable strap system for securing the glove body to a user's hand. The releasable strap system comprises a strap component and a wrist anchor component. The anchor component is able to slidably engage a wrist strap member of the strap component. The strap system releasably secures the glove body to the user's hand such that simultaneously i) the wrist strap member is contracted about a user's wrist and ii) a backhand strap member of the strap component is diagonally tensioned across the back face of the glove body such that said central component is contracted about the user's hand.

7 Claims, 4 Drawing Sheets

ANTI-SLIPPAGE GLOVE

The present invention relates to a strap system for securing a glove onto the hand of the user or wearer. The invention is in particular directed to gloves which may be worn by cross-country skiers, cyclists and the like.

Known gloves worn by cross-country skiers have a tendency to slip off of the hand of the wearer during skiing. Various types of strap systems are known for gloves but are not entirely satisfactory; please see laid open Canadian patent application no. 2,093,406, Canadian patent no. 1,291,596 as well as U.S. Pat. Nos. 272,945, 351,724, 2,567,489, 4,042,977, 4,958,384 and 5,197,149 for examples of known glove strap systems.

It would be advantageous to have means whereby the slippage of a glove off of the hand of the user could be inhibited or prevented.

It would also be advantageous to have a system for securing the glove to the wearer's hand which is relatively easily manipulated both for securing and removing a glove from a person's hand.

Accordingly, the present invention provides for a glove comprising a glove body for receiving a user's hand therein, said glove body having a palm side face, a back side face, a thumb lateral side region and an opposed outer lateral side region, said glove body comprising a central component for receiving the palm of a user's hand and a wrist cuff component for disposition adjacent a user's wrist, two or more finger components extending from said central component for receiving the fingers and thumb of the user's hand and a releasable strap system for securing the glove body to a user's hand, said releasable strap system comprising a strap component comprising a backhand strap member having a glove attachment end and a wrist strap member having a glove attachment end, said backhand strap member having a major axis extending from the attachment end thereof and a wrist anchor component for engaging said wrist strap member, said wrist cuff component comprising said wrist anchor component, said wrist anchor component being disposed on said thump lateral side region, below the finger component for the thump, said strap component and said anchor component being configured and disposed such that when a user's hand is in the glove body and said glove body is secured by the strap system to the hand said backhand strap member glove attachment end is attached to said central component, said wrist strap member glove attachment end is attached to said wrist component, said wrist strap member slidably engages said anchor component, said backhand strap member is disposed over the back side face so that the major axis thereof extends diagonally backwards away from the user's fingers, said strap component is attached to said wrist cuff component such that, between the wrist strap member glove attachment end and the anchor component, the strap component is able to extend over at least a portion of the palm side of the user's wrist, and said strap system releasably secures said glove body to the user's hand such that simultaneously i) the wrist strap member is contracted about a user's wrist and ii) the backhand strap member is diagonally tensioned across the back face of the glove body such that said central component is contracted about the user's hand.

In accordance with the present invention, the wrist strap member and the backhand strap member may advantageously be simultaneously tightened or tensioned about a user's hand for securing the glove to the user's hand. Additionally, the tether-like strap system of the present invention makes allowance for a degree of freedom of movement of the strap component through the anchor component while maintaining the backhand and wrist strap members under tension, i.e. the strap component may slide through the anchor component.

The strap system of the present invention may be releasably attached to the glove body in any suitable fashion and to any suitable part of the central and wrist components respectively, as long as the strap component is able to secure the glove to the user's hand as mentioned in paragraphs i) and ii) mentioned above.

In general, a side region or margin will include any part or portion of a marginal region of the glove body which can be used to anchor a strap attachment end thereto such that the glove may be secured to a hand as described herein; i.e. such that a transmission of tension between the two strap members may be achieved about the focal point comprising the anchor component.

Keeping the above in mind, in accordance with the present invention the glove attachment ends of the strap component may be (releasably or securely) attached, secured or fixed to the palm side face or the back side face of the glove body or even a stitched seam therebetween. The glove attachment ends of the strap component may be fixed to the opposed outer lateral side region of the glove body.

Thus, the present invention, in particular provides for a glove wherein, when a user's hand is in the glove body and said glove body is secured by the strap system to the hand, said backhand strap member glove attachment end is attached to said central component on said opposed outer lateral side region, and said wrist strap member is attached to said wrist cuff component on said opposed outer lateral side region.

The strap component may also, for example, comprise a single length of strap one or both ends of which is appropriately attached to the glove body in a releasable manner. The strap component may, for example, be firmly secured or fixed (e.g. by stitching) at one end thereof to the wrist cuff component while the other end may be releasably attachable to the central component, for example, by means of the known hook and pile fastening mechanism such as is disclosed in the above mentioned patents (see U.S. Pat. No. 4,042,977 the entire contents of which are incorporated herein by reference). Alternatively, the strap component may comprise two separate releasably engagably strap elements, i.e. the backhand strap member and the wrist strap member may be separate strap elements rather than forming part of a single unitary strap.

In accordance with the present invention, the anchor component may take on any suitable form whereby the wrist strap member may be anchored to the wrist cuff component, i.e. the wrist strap member is attachable to the wrist cuff component by the anchor component such that when the glove body is secured to a user's hand, the anchor component, by engaging the wrist strap member, inhibits slippage of the glove body from under the strap component. This anchor engagement type relationship is nevertheless such that the wrist strap member may be slidably engagable by the anchor element.

Thus the present invention in accordance with a further aspect provides a glove comprising a glove body, for receiving a user's hand therein, said glove body having a palm side face, a back side face, a thumb lateral side region and an opposed outer lateral side region, said glove body comprising a central component for receiving the palm of a user's hand, and a wrist cuff component for disposition adjacent a user's wrist, two or more finger components extending from said central portion for receiving the fingers and thumb of the user's hand and a releasable strap system for securing the glove body to a user's hand, said releasable strap system comprising a strap component comprising a backhand strap member a wrist strap member and a wrist anchor component for slidably engaging said wrist strap member, said wrist cuff component comprising said anchor component, said anchor anchor component being disposed on said thump lateral side region, below the finger component for the thump, said backhand strap member having a major axis extending from a first glove attachment end thereof to a second distal end thereof, said wrist strap member having a first glove attachment end and a second distal end, said first glove attachment end of the backhand strap member being attached to said central component portion on said opposed outer lateral side region, said backhand strap member being disposable over the back side face so that the major axis thereof extends, from said first glove attachment end thereof, diagonally backwards away from a user's fingers when a user's hand is in the glove body, said first glove attachment end of the wrist strap member being attached to said wrist cuff component on said opposed outer lateral side region such that said strap component is attached to said wrist cuff component such that, between the first glove attachment end of the wrist strap member and the anchor component, the strap component is able to extend over at least a portion of the palm side of the user's wrist, and said strap component and said anchor component being configured and disposed such that when a user's hand is in the glove body said wrist strap member slidably engages said anchor component, and the second end of the backstrap member is able to releasably engage the second end of the wrist strap member so as to secure the glove body to the user's hand such that simultaneously i) the wrist strap member is contracted about a user's wrist and ii) the backhand strap member is diagonally tensioned across the back face of the glove such that said central component is contracted about the user's hand.

In accordance with the present invention the anchor component may take the form of a ring fastener fixed to the exterior of the wrist cuff component. In this case the attachment end of the wrist strap member may be attached to the wrist cuff component on the exterior side thereof, i.e. on the back side face or on the palm face side thereof. The wrist strap member may then be configured so as to be threadable through the ring fastener for subsequent attachment to the separate backhand strap member. Alternatively, the wrist cuff component itself may define an anchor aperature for engaging the wrist strap member as discussed herein with respect to the drawings.

Thus, for example, the present invention provides a particular embodiment of a glove wherein said wrist cuff component has an interior side and an exterior side, wherein said anchor component comprises an anchor aperature defined by said wrist cuff component, wherein said first glove attachment end of the wrist strap member is attached to said wrist cuff component such that a portion of said wrist strap member is disposable on the interior side thereof adjacent the underside of the user's wrist and said wrist strap member is able to extend from the interior side of the wrist component to the exterior side thereof through the anchor aperature.

A glove in accordance with the present invention may alternatively have a plurality (e.g. two, three or more) of the above mentioned ring fasteners and/or anchor aperatures and the like through which may be threaded said wrist strap member.

As mentioned above, the separate strap members may be releasably attachable to each other and/or to the glove body by any suitable means keeping in mind the purpose of the strap system, namely to secure the glove body to the hand of the user such that the wrist strap member is contracted about the user's wrist while at the same time, the central component is contracted about the user's hand due to the diagonal tensioning of the backhand strap member. In this respect the fastening mechanism may as indicated above be of the hook/pile type (e.g. a VELCRO type fastener system—velcro is a trade mark for a known type of hook/pile fastener).

Alternatively, the distal attachment ends of the separate strap members may be provided with a cinchable type fastening system which may facilitate the tightening of the strap system about a glove.

Thus, the present invention in a further particular aspect provides a glove wherein the second end of one of said backhand strap and said wrist strap members comprises a ring connector and the second end of the other strap member comprises a fastening surface whereby the strap component may be cinched tight in place about the glove body, said fastening surface comprising a hook surface and a pile surface configured and disposed such that the second end comprising said fastening surface may be threaded through said ring connector and be folded back onto itself such that the hook and pile surfaces are able to be pressed together such that they interact to releasably secure the strap members together.

In accordance with a further embodiment of the present invention a glove is provided wherein the second end of said wrist strap member comprises a ring connector and the second end of said backhand strap member comprises a fastening surface whereby the strap component may be cinched tight in place about the glove body, said fastening surface comprising a hook surface and a pile surface configured and disposed such that the second end of said backhand strap member may be threaded through said ring connector and be folded back onto itself such that the hook and pile surfaces are able to be pressed together such that they interact to releasably secure the strap members together.

In accordance with the present invention the finger components may be complete finger stalls for covering the fingers and/or thump or else they may be partial finger stalls wherein the ends of the fingers and/or thump are exposed; such exposed configurations for the finger stalls are known.

The wrist cuff component may be configured as desired to completly or only partially encircle or be disposed about the user's wrist, again keeping in mind the above mentioned nature of the strap system.

The wrist strap member may for example be attached to the interior side of the wrist component opposite the backside face of the wrist cuff component at the opposed outer lateral side region of the glove body. The outer lateral side region may for example include a longitudinal slit in the wrist component; the wrist strap member being attached to the underside of the back side part of the wrist component.

In drawings which illustrate an example embodiment of the present invention

Figure 2:
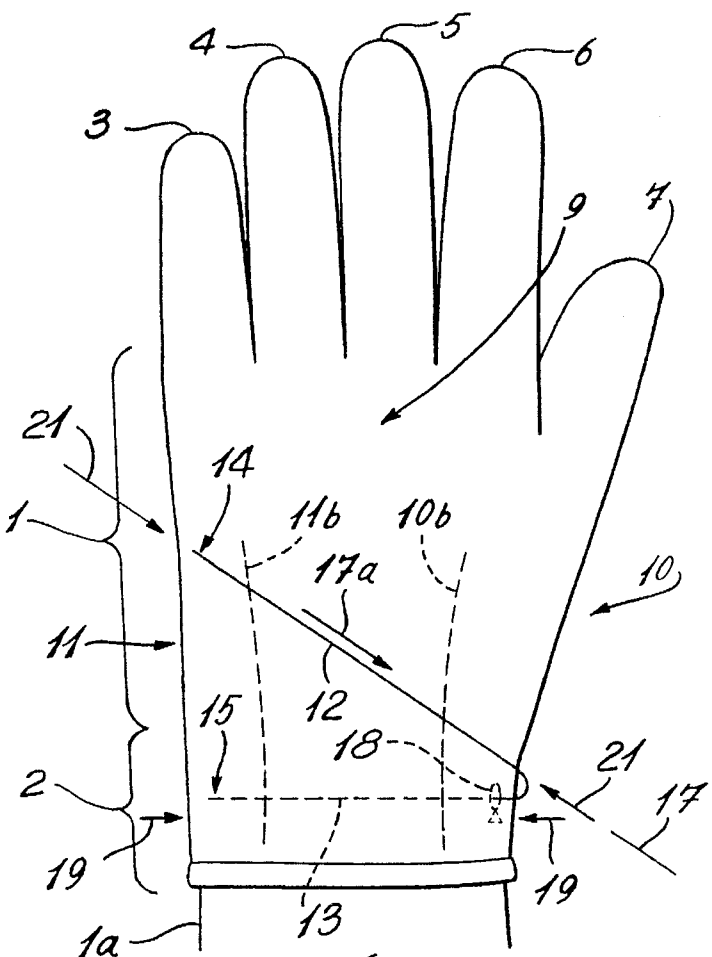
FIG. 2 is a general schematic back side represention of the example glove of FIG. 1.
Figure 1:
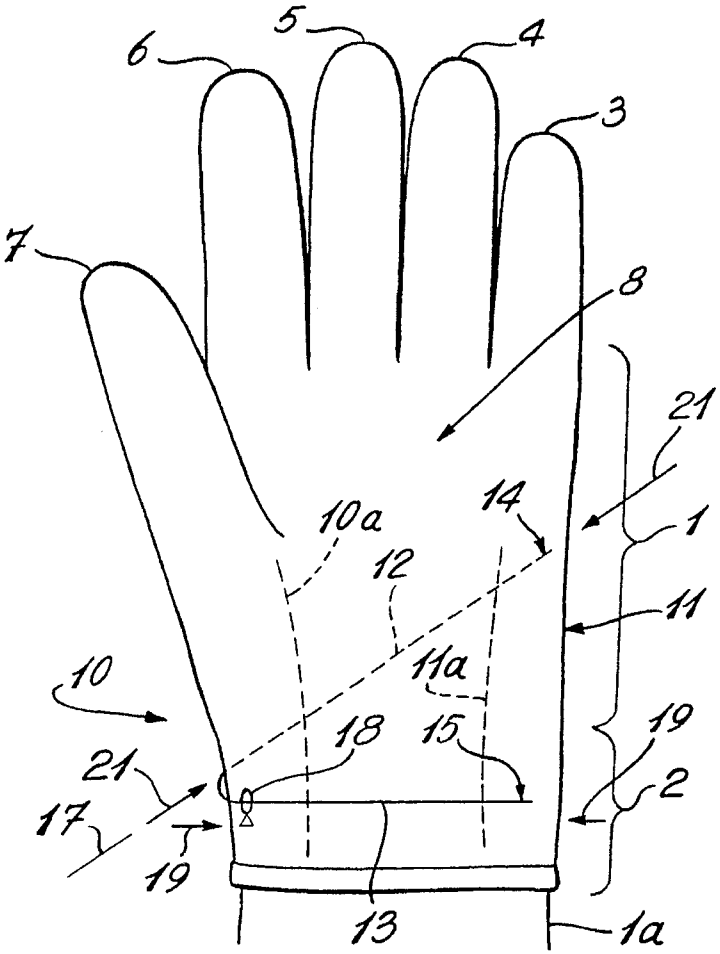
FIG. 1 is a general schematic palm side represention of an example glove of the present invention.

FIGS. 1 and 2 show schematically in general fashion a glove in accordance with the present invention wherein the strap system is shown as securing the glove body to a user's hand indicated generally by the reference numeral 1*a*. The glove has a glove body comprising a central component indicated generally by the reference numeral 1, and a wrist cuff component indicated generally by the reference numeral 2. The finger components or stalls 3, 4, 5, 6 and 7 for receiving the fingers and thumb of a user extend from the glove body; the stalls are illustrated as being configured to completly cover the fingers and thumb.

The glove body has palm side face 8, a back side face 9, a thumb lateral side region indicated generally by the reference numeral 10 and an opposed outer lateral side region indicated generally by the reference numeral 11. A side or edge region includes a marginal part of the glove on both the palm side and back side thereof. For illustration purposes only, example side region boundaries are indicated generally by a pair of dotted lines on the palm side face and the back side face of the glove body, namely boundary lines 10*a* and 10*b* for the thumb lateral side region and boundary lines 11*a* and 11*b* for the opposed lateral side region.

In FIGS. 1 and 2 the strap members of the strap component are shown by line representations, namely backhand strap member 12 and wrist strap member 13; the strap component shown is a single unitary strap. In the embodiment shown the wrist strap member 13 is on the exterior side of the wrist cuff component, i.e. strap member 13 is disposed over the palm side face 8 of the glove body i.e. for disposition over the underside of the user's wrist.

The strap component has glove attachment ends 14 and 15 which are attached to the glove on the opposed outer lateral side 11 region of the glove body. In the embodiment shown ends 14 and/or 15 may be releasably attached to the glove body by a hook/pile fastening arrangement. If desired, end 15 may, for example, be securely fixed in place by stitches on the palm side face 8 while the end 14 may be releasably attached to the same side region 11 but on the back side face 9. In this latter case, the hook and pile fastening surfaces may, for example, be respectively disposed on the glove and on the attachement end 14 of the strap component; the strap component may be pulled by the free attachment end 14 so that the strap component is tightened about the glove before the end 14 is releasably attached to the glove.

The back hand strap member 12 has a major axis which is indicated by the axis line 17. As may be seen, the backhand strap 12 is disposed over the back side face 9 of the glove body such that the major axis 17 extends diagonally backwards away from the finger components as shown by arrow 17*a* in FIG. 2.

The strap system includes a ring fastener 18 which is fixed or attached to the palm side face 8 of the glove body on the thumb lateral side region 10 of the glove body below the thumb finger component 7, i.e. on the wrist cuff component 2 the glove body.

The wrist strap member 13 is slidingly threaded through the opening of the ring fastener 18 and is connected to the diagonally tensioned backhand strap member 12 such that the wrist component 2 is contracted about the user's wrist in the direction of the arrows 19, and the portion of the glove body therebelow will be inhibited from slipping under the strap component. The back hand strap member 12, in the securing configuration shown, is simultaneously tensioned such that it pulls on the attached end 14 whereby the central component is compressed in the direction of the arrows 21 about the user's hand.

Figures 3, 4:
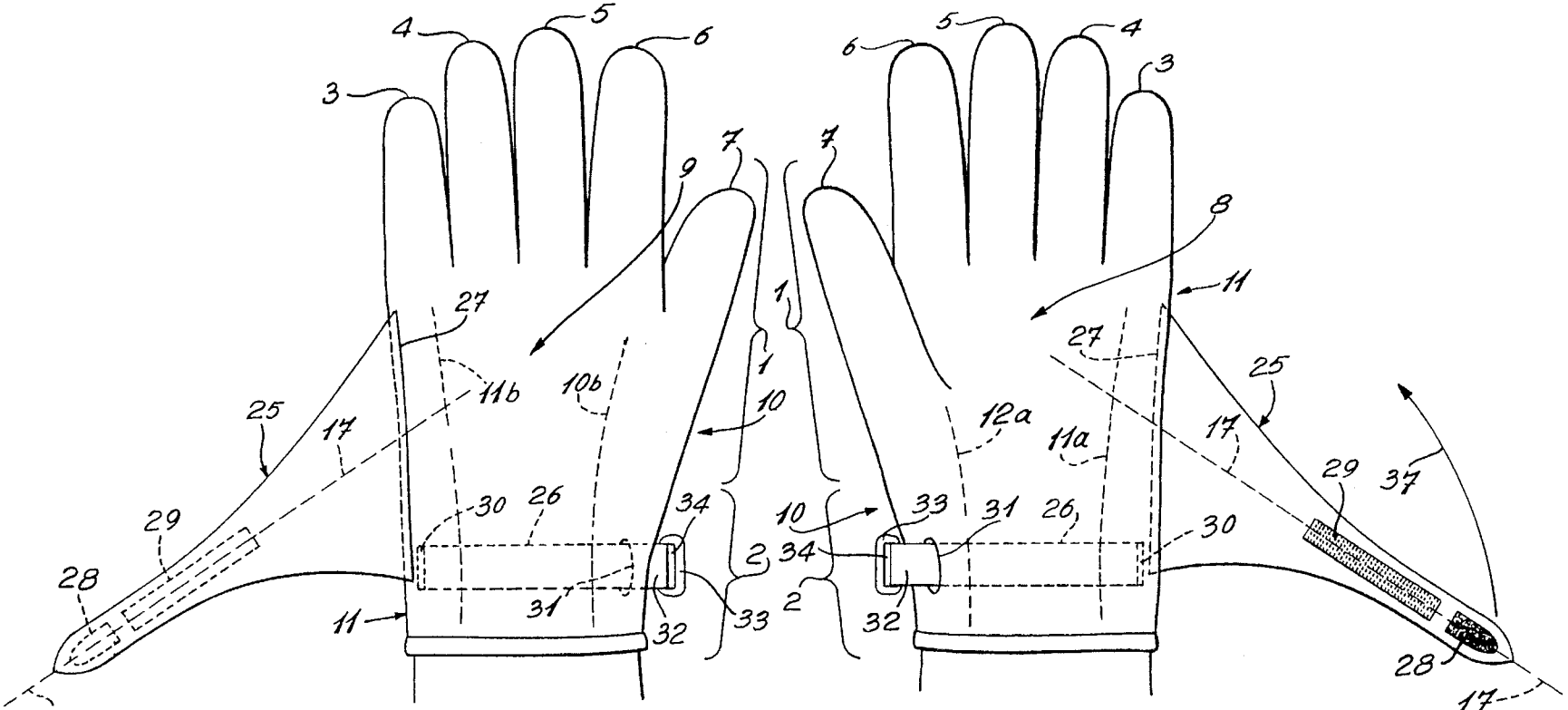
FIG. 3 is a schematic back side represention of a glove provided with an example strap system in accordance with the present invention comprising a two part strap component.
FIG. 4 is a schematic palm side represention of the example glove of FIG. 3.
Figure 5:
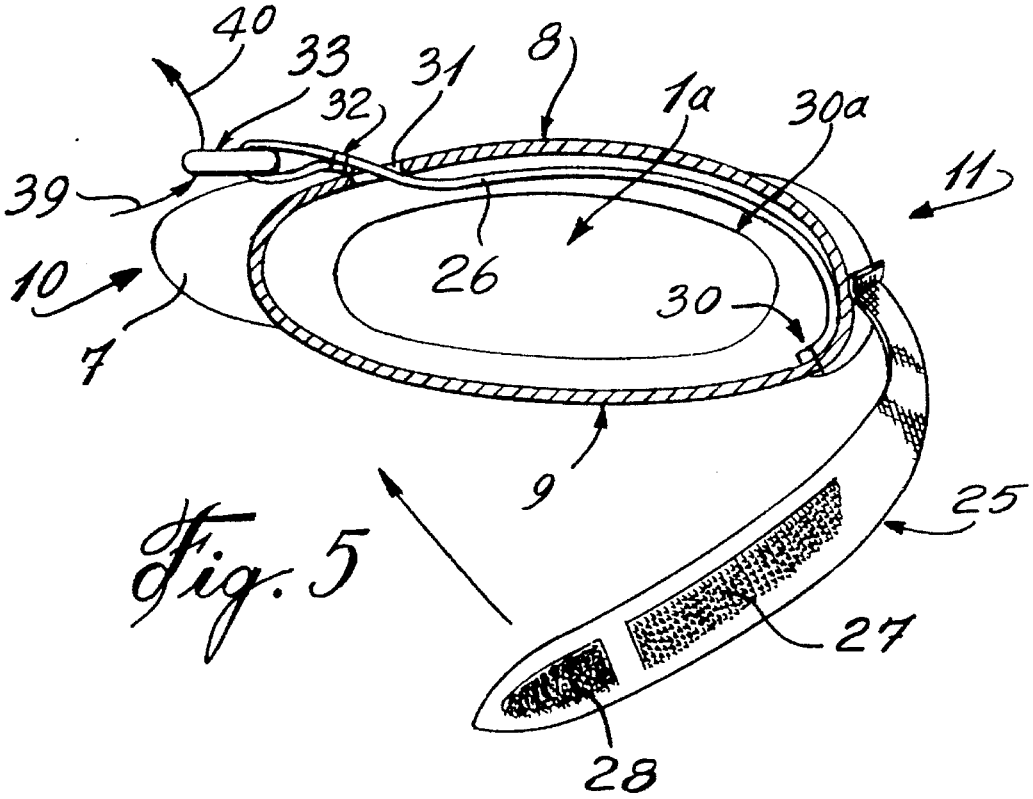
FIG. 5 is a schematic bottom represention of the example glove of FIG. 3 showing the hand opening and the wrist cuff component disposed about the opening.
Figure 6:
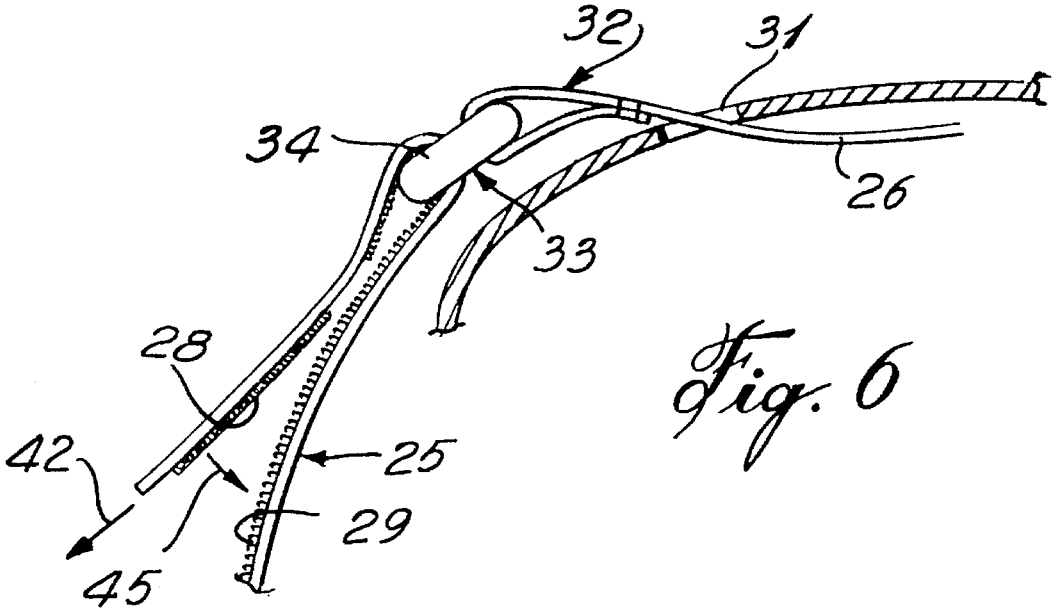
FIG. 6 is a partial schematic side represention of the cinch fastening mechanism for securing together the backhand and wrist strap members of the glove in FIG. 3.
Figure 8:
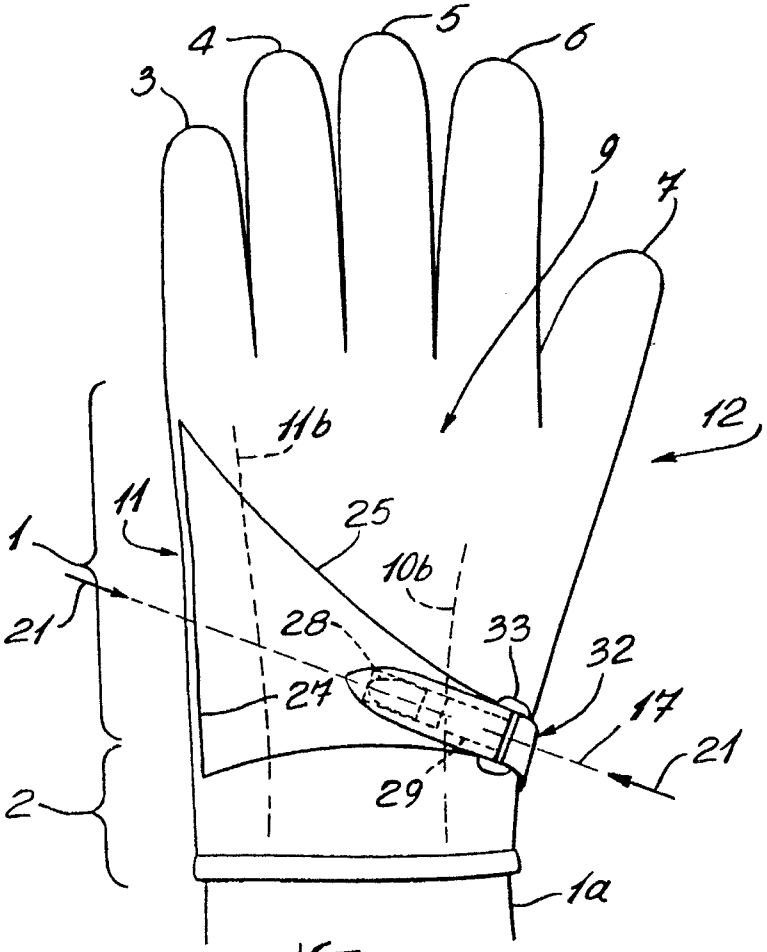
FIG. 8 is a schematic back side represention of the glove of FIG. 3 wherein the strap system is shown in a secured configuration about the glove body.
Figure 7:
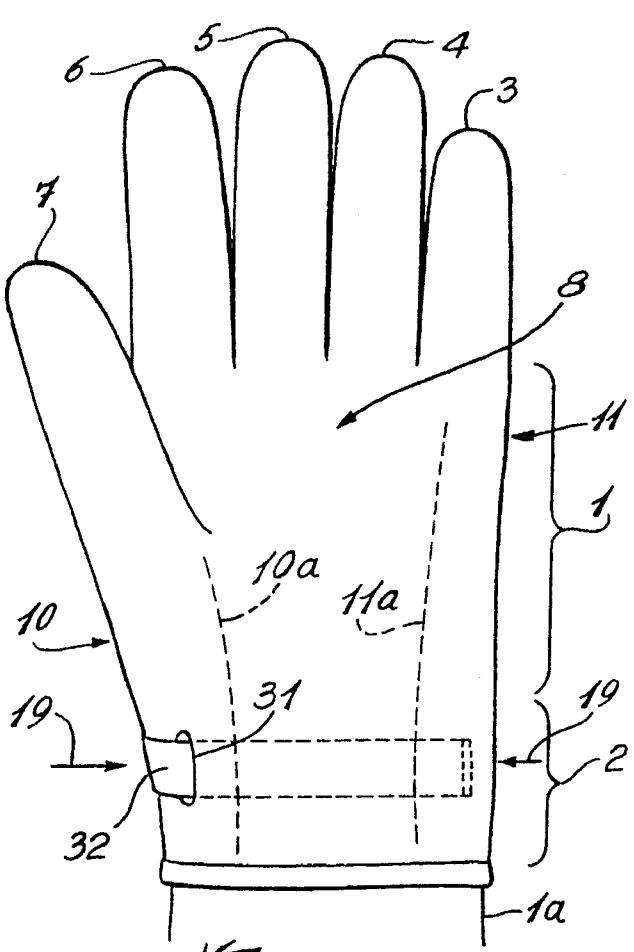
FIG. 7 is a schematic palm side represention of the glove of FIG. 3 wherein the strap system is shown in a secured configuration about the glove body.

FIGS. 3 to 8 show an example glove provided with a two part strap component for the strap system. FIGS. 3 and 4 show the glove with the strap system in a released configuration. FIGS. 5 and 6 are illustrative of the process whereby the glove passes to a secured configuration on a user's hand 1*a*. FIGS. 7 and 8 show the example glove in a secured configuration on a users hand 1*a*.

Referring to FIGS. 3 and 4 the strap component has an elongated triangle shaped backhand strap member 25 as well as a separate wrist strap member 26 which is releasably connectable to the strap member 25. The backhand strap member 25 has the major axis 17 mentioned above. The glove attachement end 27 of the backhand strap member 25 is attached (e.g. stitched) on the opposed outer lateral side region 11 of the glove body, on the outer surface of the glove body, i.e. on the back side face 9. Alternatively, the end 27 may be disposed between the palm side face and the back side face in any side stitched seam whereby the back side of the glove body is fixed to the palm side thereof. The backhand strap member 25 has a two part fastening surface at the second distal end thereof; a first surface part 28 comprises a pile material whereas the second surface part 29 comprises a hook material. As explained above, the two part fastening surface system is of VELCRO type.

The wrist strap member 26 is attached (e.g. stitched) on the opposed outer lateral side 11 region of the glove body but to the interior side of the wrist cuff component 2 which is opposite to the back side of the glove body; the attachement point is indicated by the reference numeral 30. As may be seen from FIG. 5 the wrist strap member 26 is disposed so as to be able to engage the underside or palm side 30*a* of a users wrist. The strap member 26 extends from the interior side of the wrist cuff component 2 to the exterior side thereof through anchor aperature or opening 31. The end part 32 of the wrist strap member 26 is provided with a ring fastener 33; the ring fastener is sized so as to have an opening 34 through which the surface fastener end of the backhand strap member 25 having the two part fastener surface may be threaded.

If desired, the wrist strap member 26 may be of elastic or non-elastic material e.g. the wrist strap member 26 may be extensible; the backhand strap may likewise be extensible or non-extensible. The strap members may, however, be made of any suitable or necessary material as may be the glove as a whole.

Referring to FIGS. 4, 5 and 6, the glove is secured to the hand of a user by folding the backhand strap member 25 in the direction of the arrow 37 over the back side face 9 of the glove body. The fastener surface end of the backhand strap member 25 is then threaded through the opening 34 of the ring fastener or connector 33 in the direction of the arrows 39 and 40 (FIG. 5).

Referring to FIG. 6, once the fastener end of the backhand strap 25 is threaded through the opening 34, the fastener end is pulled in the direction of the arrow 42 so as to cinch tight the strap component about the users hand; thereafter the surface parts 28 and 29 of the fastener end are pressed together in the direction of the arrow 45 to secure the strap component in the (tight) secured position. As may be understood from FIG. 5, pulling on the surface fastener end causes the strap component to be simultaneously tensioned with respect to both the backhand strap member 25 and the wrist strap member 26 such that once the fastener surfaces are pressed together for releasably securing the glove to the user's hand, the wrist strap member 26 is contracted about the user's wrirst and the backhand strap member 25 is tensioned across the back side face 9 such that the central component 1 is also contracted about the user's hand.

FIGS. 7 and 8 show the glove in a secured configuration

The embodiments of the invention in which an exclusive property or privilege is claimed are as follows:

1. A glove comprising a glove body, for receiving a user's hand therein, said glove body having a palm side face, a back side face, a thumb lateral side region and an opposed outer lateral side region, said glove body comprising a central component for receiving the palm of a user's hand, and a wrist cuff component for disposition adjacent a user's wrist, two or more finger components extending from said central component for receiving the fingers and thumb of the user's hand and a releasable strap system for securing the glove body to a user's hand, said releasable strap system comprising a strap component comprising a backhand strap member having a glove attachment end and a wrist strap member having a glove attachment end, said backhand strap member having a major axis extending from the attachement end thereof and a wrist anchor component for slidably engaging said wrist strap member, said wrist cuff component comprising said wrist anchor component, said wrist anchor component being disposed on said thumb lateral side region, below the finger component for the thumb, said strap component and said anchor component being configured and disposed such that when a user's hand is in the glove body and said glove body is secured by the strap system to the hand said backhand strap member glove attachment end is attached to said central component, said wrist strap member glove attachment end is attached to said wrist component, said wrist strap member slidably engages said anchor component, said backhand strap member is disposed over the back side face so that the major axis thereof extends diagonally backwards away from the user's fingers, said strap component is attached to said wrist cuff component such that, between the wrist strap member glove attachment end and the anchor component, the strap component is able to extend over at least a portion of the palm side of the user's wrist, and said strap system releasably secures said glove body to the user's hand such that simultaneously i) the wrist strap member is contracted about a user's wrist and ii) the backhand strap member is diagonally tensioned across the back face of the glove body such that said central component is contracted about the user's hand.

2. A glove as defined in claim 1 wherein said backhand strap member and said wrist strap member are separate strap elements, said separate strap members being releasably engageable for securing the glove body to the hand of the wearer thereof, and wherein when a user's hand is in the glove body and said glove body is secured by the strap system to the hand said backhand strap member glove attachment end is attached to said central component on said opposed outer lateral side region, and said wrist strap member is attached to said wrist cuff component on said opposed outer lateral side region.

3. A glove comprising a glove body, for receiving a user's hand therein, said glove body having a palm side face, a back side face, a thumb lateral side region and an opposed outer lateral side region, said glove body comprising a central component for receiving the palm of a user's hand, and a wrist cuff component for disposition adjacent a user's wrist, two or more finger components extending from said central portion for receiving the fingers and thumb of the user's hand and a releasable strap system for securing the glove body to a user's hand, said releasable strap system comprising a strap component comprising a backhand strap member a wrist strap member and a wrist anchor component for slidably engaging said wrist strap member, said wrist cuff component comprising said anchor component, said anchor anchor component being disposed on said thump lateral side region, below the finger component for the thump, said backhand strap member having a major axis extending from a first glove attachment end thereof to a second distal end thereof, said wrist strap member having a first glove attachment end and a second distal end, said first glove attachment end of the backhand strap member being attached to said central component portion on said opposed outer lateral side region, said backhand strap member being disposable over the back side face so that the major axis thereof extends, from said first glove attachment end thereof, diagonally backwards away from a user's fingers when a user's hand is in the glove body, said first glove attachment end of the wrist strap member being attached to said wrist cuff component on said opposed outer lateral side such that said strap component is attached to said wrist cuff component such that, between the first glove attachment end of the wrist strap member and the anchor component, the strap component is able to extend over at least a portion of the palm side of the user's wrist, and said strap component and said anchor component being configured and disposed such that when a user's hand is in the glove body said wrist strap member slidably engages said anchor component, and the second end of the backstrap member is able to releasably engage the second end of the wrist strap member so as to secure the glove body to the user's hand such that simultaneously i) the wrist strap member is contracted about a user's wrist and ii) the backhand strap member is diagonally tensioned across the back face of the glove such that said central component is contracted about the user's hand.

4. A glove as defined in claim 3 wherein said wrist cuff component has an interior side and an exterior side, wherein said anchor component comprises an anchor aperature defined by said wrist cuff component, wherein said first glove attachment end of the wrist strap member is attached to said wrist cuff component such that a portion of said wrist strap member is disposable on the interior side thereof adjacent the underside of the user's wrist and said wrist strap member is able to extend from the interior side of the wrist component to the exterior side thereof through the anchor aperature.

5. A glove as defined in claim 3 wherein the second end of one of said backhand strap and said wrist strap members comprises a ring connector and the second end of the other strap member comprises a fastening surface whereby the strap component may be cinched tight in place about the glove body, said fastening surface comprising a hook surface and a pile surface configured and disposed such that the second end comprising said fastening surface may be threaded through said ring connector and be folded back onto itself such that the hook and pile surfaces are able to be pressed together such that they interact to releasably secure the strap members together.

6. A glove as defined in claim 4 wherein the second end of said wrist strap member comprises a ring connector and the second end of said backhand strap member comprises a fastening surface whereby the strap component may be cinched tight in place about the glove body, said fastening surface comprising a hook surface and a pile surface configured and disposed such that the second end of said backhand strap member may be threaded through said ring connector and be folded back onto itself such that the hook and pile surfaces are able to be pressed together such that they interact to releasably secure the strap members together.

7. A glove as defined in claim 4 wherein the wrist strap member is attached to said wrist cuff component on the interior side thereof opposite the back side face of the wrist cuff component.

* * * * *